US010863280B2

(12) United States Patent
Liang

(10) Patent No.: US 10,863,280 B2
(45) Date of Patent: Dec. 8, 2020

(54) SOUND PRODUCING DEVICE

(71) Applicant: xMEMS Labs, Inc., Los Altos, CA (US)

(72) Inventor: Jemm Yue Liang, Sunnyvale, CA (US)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 16/528,563

(22) Filed: Jul. 31, 2019

(65) Prior Publication Data

US 2020/0288248 A1 Sep. 10, 2020

Related U.S. Application Data

(60) Provisional application No. 62/814,279, filed on Mar. 5, 2019.

(51) Int. Cl.

| | |
|---|---|
| ***H04R 7/02*** | (2006.01) |
| ***H04R 9/04*** | (2006.01) |
| ***H04R 3/00*** | (2006.01) |
| *H04R 1/06* | (2006.01) |

(52) U.S. Cl.

CPC ..... *H04R 7/02* (2013.01); *H04R 3/002* (2013.01); *H04R 9/042* (2013.01); *H04R 1/06* (2013.01)

(58) Field of Classification Search

CPC ..... H04R 7/02; H04R 9/042; H04R 3/002; H04R 1/06

See application file for complete search history.

(56) References Cited

U.S. PATENT DOCUMENTS

| | | | | |
|---|---|---|---|---|
| 3,636,278 | A * | 1/1972 | Heil | H04R 7/14 381/163 |
| 2014/0294218 | A1* | 10/2014 | Suvanto | H04R 1/222 381/337 |
| 2015/0208175 | A1* | 7/2015 | Pinkerton | H04R 1/26 381/165 |
| 2016/0234603 | A1* | 8/2016 | Pinkerton | H04R 1/403 |
| 2016/0381464 | A1* | 12/2016 | Elyada | H04R 19/02 381/97 |
| 2017/0026726 | A1 | 1/2017 | Kim | |
| 2017/0041708 | A1 | 2/2017 | Barzen | |
| 2018/0179048 | A1* | 6/2018 | Schenk | B81C 1/0015 |
| 2018/0273372 | A1* | 9/2018 | Piechocinski | H04R 3/00 |
| 2019/0020956 | A1 | 1/2019 | Pinkerton | |

FOREIGN PATENT DOCUMENTS

| | | | |
|---|---|---|---|
| EP | 3 611 939 | A1 | 2/2020 |
| JP | 2009-239518 | A | 10/2009 |
| KR | 10-2017-0011795 | A | 2/2017 |

* cited by examiner

*Primary Examiner* — Tuan D Nguyen
(74) *Attorney, Agent, or Firm* — Winston Hsu

(57) ABSTRACT

A sound producing device is provided. The sound producing device includes a membrane, disposed within a chamber, controlled by a membrane control signal to cause a membrane movement; and a first deflector, disposed within a first opening by the membrane, controlled by a first deflector control signal to cause a first deflector rotation; wherein the sound producing device produces a plurality of air pulses via the membrane movement and the first deflector rotation, the plurality of air pulses has an air pulse rate, the air pulse rate is higher than a maximum human audible frequency; wherein the plurality of air pulses produces a non-zero offset in terms of sound pressure level, and the non-zero offset is a deviation from a zero sound pressure level.

17 Claims, 5 Drawing Sheets

SOUND PRODUCING DEVICE

CROSS REFERENCE TO RELATED APPLICATIONS

This application claims the benefit of U.S. provisional application No. 62/814,279, filed on Mar. 5, 2019, which is incorporated herein by reference.

BACKGROUND OF THE INVENTION

1. Field of the Invention

The present application relates to a sound producing device, and more particularly, to a sound producing device with reduced circuit area and manufacture complexity.

2. Description of the Prior Art

Speaker driver is always the most difficult challenge for high-fidelity sound reproduction in the speaker industry. The physics of sound wave propagation teaches that, within the human audible frequency range, the sound pressures generated by accelerating a membrane of a conventional speaker driver may be expressed as $P \propto SF \cdot AR$, where SF is the membrane surface area and AR is the acceleration of the membrane. Namely, the sound pressure P is proportional to the product of the membrane surface area SF and the acceleration of the membrane AR. In addition, the membrane displacement DP may be expressed as $DP \propto 1/2 \cdot AR \cdot T^2 \propto 1/f^2$, where T and f are the period and the frequency of the sound wave respectively. The air volume movement $V_{A,CV}$ caused by the conventional speaker driver may then be expressed as $V_{A,CV} \propto SF \cdot DP$. For a specific speaker driver, where the membrane surface area is constant, the air movement $V_{A,CV}$ is proportional to $1/f^2$, i.e., $V_{A,CV} \propto 1/f^2$.

To cover a full range of human audible frequency, e.g., from 20 Hz to 20 KHz, tweeter(s), mid-range driver(s) and woofer(s) have to be incorporated within a conventional speaker. All these additional components would occupy large space of the conventional speaker and will also raise its production cost. Hence, one of the design challenges for the conventional speaker is the impossibility to use a single driver to cover the full range of human audible frequency.

Another design challenge for producing high-fidelity sound by the conventional speaker is its enclosure. The speaker enclosure is often used to contain the back-radiating wave of the produced sound to avoid cancelation of the front radiating wave in certain frequencies where the corresponding wavelengths of the sound are significantly larger than the speaker dimensions. The speaker enclosure can also be used to help improve, or reshape, the low-frequency response, for example, in a bass-reflex (ported box) type enclosure where the resulting port resonance is used to invert the phase of back-radiating wave and achieves an in-phase adding effect with the front-radiating wave around the port-chamber resonance frequency. On the other hand, in an acoustic suspension (closed box) type enclosure, the enclosure functions as a spring which forms a resonance circuit with the vibrating membrane. With properly selected speaker driver and enclosure parameters, the combined enclosure-driver resonance peaking can be leveraged to boost the output of sound around the resonance frequency and therefore improve the performance of resulting speaker.

To overcome the design challenges of speaker driver and enclosure within the sound producing industry, a PAM-UPA (Pulse Amplitude Modulated Ultrasonic Pulse Array) sound producing scheme and corresponding sound producing device (SPD) comprising a plurality of air pulse generating elements have been proposed. However, the SPD with the plurality of air pulse generating elements requires more circuit area and manufacture complexity.

Therefore, how to reduce circuit area and manufacture complexity is a significant objective in the field.

SUMMARY OF THE INVENTION

It is therefore a primary objective of the present application to provide a sound producing device with reduced circuit area and manufacture complexity An embodiment of the present application provides a sound producing device, comprising a membrane, disposed within a chamber, controlled by a membrane control signal to cause a membrane movement; and a first deflector, disposed within a first opening by the membrane, controlled by a first deflector control signal to cause a first deflector rotation; wherein the sound producing device produces a plurality of air pulses via the membrane movement and the first deflector rotation, the plurality of air pulses has an air pulse rate, the air pulse rate is higher than a maximum human audible frequency; wherein the plurality of air pulses produces a non-zero offset in terms of sound pressure level, and the non-zero offset is a deviation from a zero sound pressure level.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
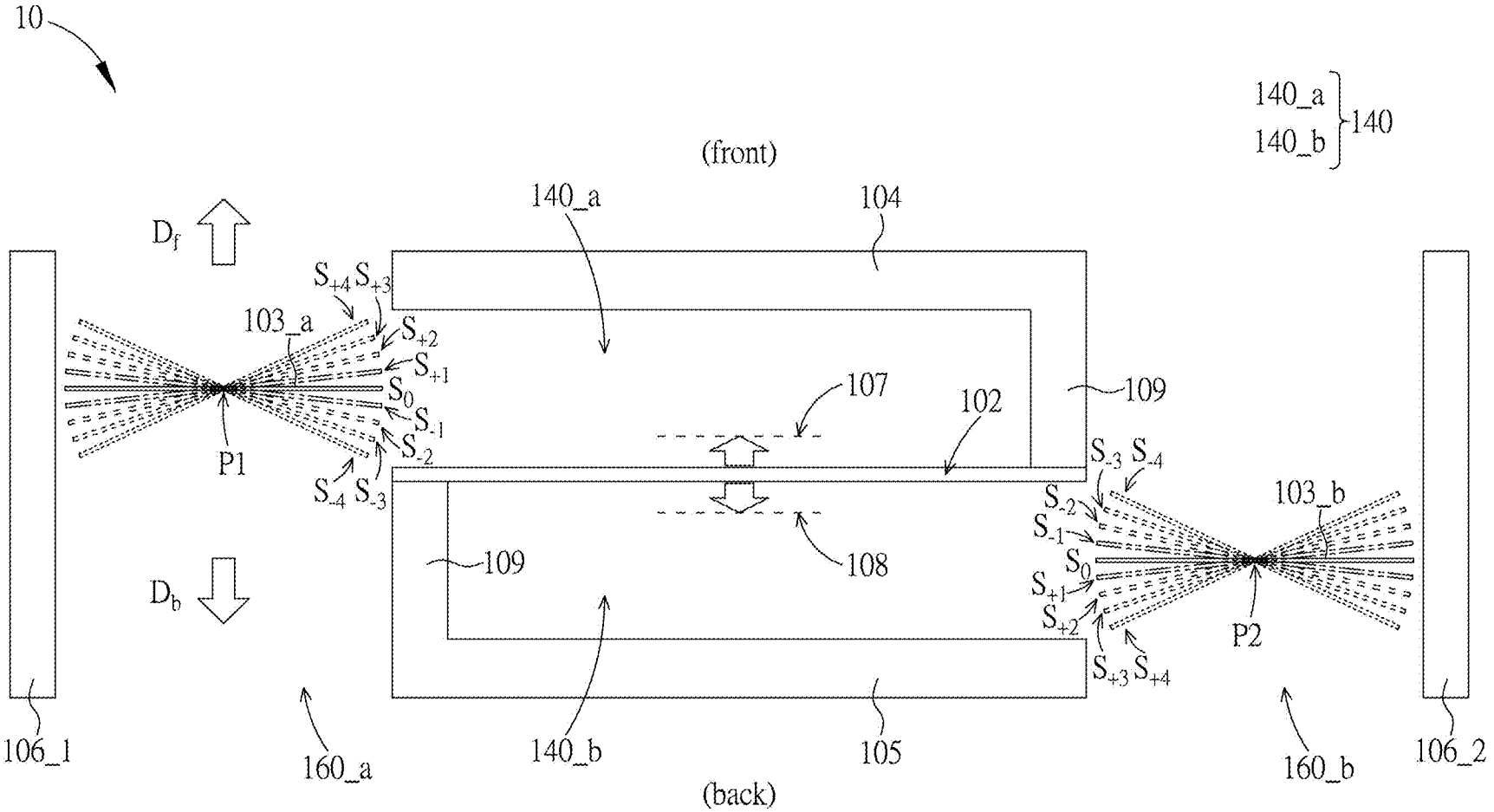
FIG. 1 is a schematic diagram of a cross sectional view of a sound producing device according to an embodiment of the present application.
Figure 2:
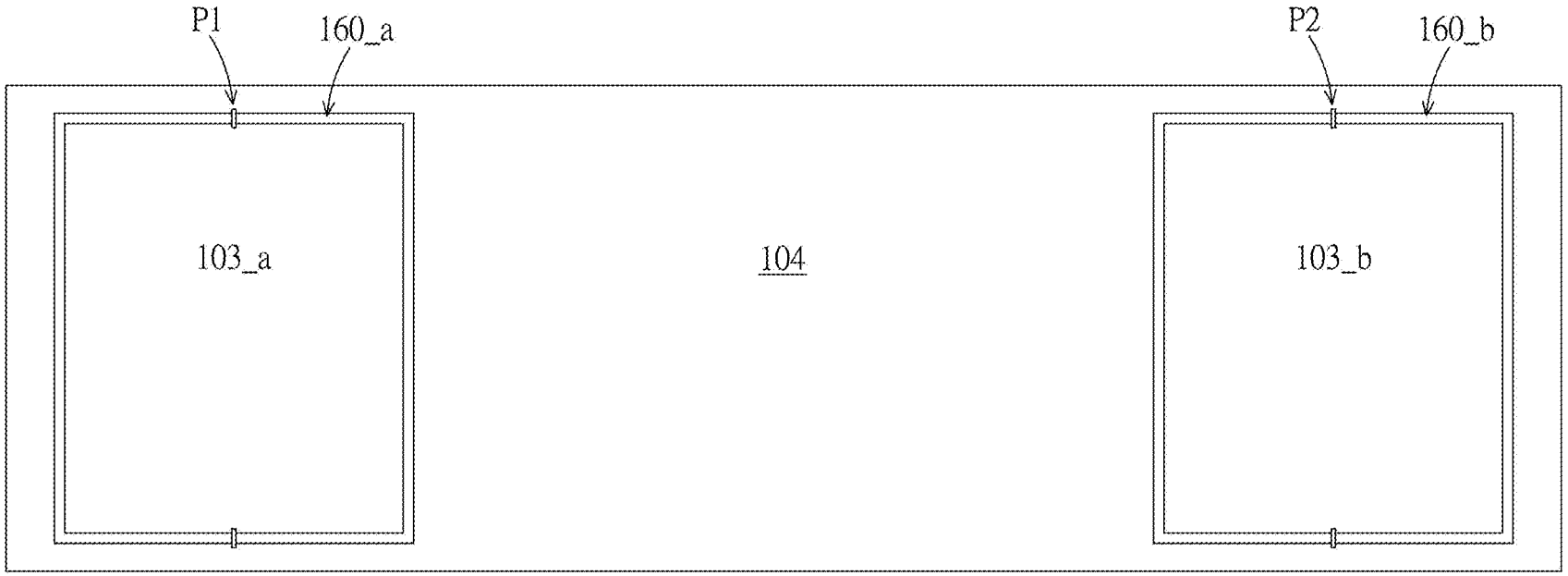
FIG. 2 is a schematic diagram of a top view of the sound producing device of FIG. 1.

FIG. 1 and FIG. 2 are schematic diagrams of a cross sectional view and a top view of a sound producing device (abbreviated as "SPD") 10 according to an embodiment of the present application. The SPD 10 is similar to the air pulse generating element disclosed in U.S. application Ser. No. 16/125,761, and comprises a membrane 102, faceplates 104 and 105, side walls 106_1 and 106_2 and membrane supporting elements 109. A chamber 140 is formed between the faceplates 104 and 105. The membrane 102 is disposed within the chamber 140 and partitions the chamber 140 into a first sub-chamber 140_*a* and a second sub-chamber 140_*b*. The membrane 102 is controlled by a membrane control signal $V_{MBN}$ to cause a membrane movement, e.g., the membrane 102 may move to a position 107 or to a position 108 in response to the membrane control signal $V_{MBN}$. Similar to U.S. application Ser. No. 16/125,761, the SPD 10 is able to produce a plurality of air pulses with an air pulse rate. The air pulse rate may be, e.g., 40 KHz, an ultrasonic rate, and is higher than a maximum human audible frequency, which is generally considered to be 20K Hz, like what U.S. application Ser. No. 16/125,761 does.

Different from the air pulse generating element in U.S. application Ser. No. 16/125,761, the SPD 10 comprises a first deflector 103_a and a second deflector 103_b. The deflector 103_a/103_b is disposed within an openings 160_a/160_b by the membrane 102, fixed by a pivot P1/P2. In a neutral state of the deflector, in which the deflectors 103_a and 103_b do not rotate (annotated as a state $S_0$ in FIG. 1), the deflector 103_a/103_b is aligned to the sub-chamber 140_a/140_b. In other words, the deflector 103_a/103_b is disposed to be parallel to the membrane 102, i.e., a deflector plane (at which the deflector 103_a/103_b lies in the neutral state of the deflector) is parallel to a membrane plane (at which the membrane 102 lies in a neutral state of the membrane).

Actuating means applied for the membrane 102 and/or the deflectors 103_a, 103_b is not limited. A membrane actuator (omitted in FIG. 0.1) can be attached to the membrane 102, driven by the membrane control signal $V_{MBN}$ to cause the membrane movement. Similarly, a deflector actuator (omitted in FIG. 1 and FIG. 2) can also be attached to the deflectors 103_a/103_b, driven by a deflector control signal $V_{D,a}/V_{D,a}$ to cause the deflector rotation. The membrane actuator and the deflector actuator may be piezoelectric actuator, Lorenz force actuator, or electrostatic actuator, which is not limited thereto. Details of the actuator may be referred to U.S. application Ser. No. 16/125,761, Ser. Nos. 16/172,876 and 16/379,746, which is not narrated herein for brevity.

Take the deflector 103_a as an example, or in the perspective of the deflector 103_a and the sub-chamber 140_a, the deflector 103_a is controlled by the first deflector control signal $V_{D,a}$ to cause a first deflector rotation with respect to the pivot P 1. A first rotation angle $\varphi_a$ of the first deflector 103_a may have a monotonic relationship with the first deflector control signal $V_{D,a}$. That is, the rotation angle $\varphi_a$ may increase as the deflector control signal $V_{D,a}$ increases, or $\varphi_a$ may decrease as the deflector control signal $V_{D,a}$ increases. In an embodiment, the first rotation angle $\varphi_a$ may be proportional to the first deflector control signal $V_{D,a}$, i.e., the first rotation angle $\varphi_a$ may be expressed as $\varphi_a = kV_{D,a}$, where k is a constant which can be either positive or negative.

In an embodiment, the deflector 103_a may be controlled by the first deflector control signal $V_{D,a}$ to rotate to states $S_{+4}, S_{+3}, S_{+2}, S_{+1}, S_{-1}, S_{-2}, S_{-3}, S_{-4}$ illustrated in FIG. 1. The positive sign "+" in the subscript means that the deflector 103_a rotates counter-clockwise and the deflector 103_b rotates clockwise. The negative sign "−" in the subscript means the deflector 103_a rotates clockwise and the deflector 103_b rotates counter-clockwise. At the state $S_n$, the first rotation angle $\varphi_a$ may be expressed as $\varphi_a = n \cdot \delta$, where $\delta$ represents a particular angle, i.e., 5°, and n represents an integer ranging from −4 to +4, for the current embodiment.

Supposed that the membrane 102 is driven from the position 108 to the position 107, an air pressure or an air mass velocity within the sub-chamber 140_a cause by the membrane movement is diverted most toward a front direction $D_f$ and least toward a back direction $D_b$ when the deflector 103_a rotates to the state $S_{-4}$ illustrated in FIG. 1. On the other hand, under the same case that the membrane movement is from the position 108 to the position 107, the air pressure or the air mass velocity within the sub-chamber 140_a cause by the membrane movement is diverted toward the front direction $D_f$ least and toward the back direction $D_b$ most when the deflector 103_a rotates to the state $S_{+4}$ illustrated in FIG. 1. For the other states $S_{+3}, S_{+2}, S_{+1}, S_0, S_{-1}, S_{-2}, S_{-3}$, the air flow diverted toward the front direction $D_f$ is in the middle.

In other words, given $avf_a(S_n)$ denotes an air mass velocity diverted by the defector 103_a toward the front direction $D_f$ when the defector 103_a rotates to the state $S_n$, under the case that the membrane movement is from the position 108 to the position 107, it can be obtained that $avf_a(S_{+4}) < avf_a(S_{+3}) < avf_a(S_{+2}) < avf_a(S_{+1}) < avf_a(S_0) < avf_a(S_{-1}) < avf_a(S_{-2}) < avf_a(S_{-3}) < avf_a(S_{-4})$.

Similar principles can be applied to the second deflector 103_b. A deflector control signal $V_{D,b}$ may be applied on the second deflector 103_b to cause a second rotation angle $\varphi_b$. Details of which are not narrated for brevity.

Note that, for the air pulse generating element using valves, as disclosed in U.S. application Ser. No. 16/125,761, an amplitude of the generated air pulse is determined by the membrane area of the air pulse generating element. Once the air pulse generating element is determined and manufactured, in order to produce various output sound pressure level (SPL), it relies on the plurality of air pulse generating elements (with valves) operating simultaneously, which is equivalent to achieving membrane vibration caused by membranes with various membrane areas. Notably, it can be understood that the plurality of air pulse generating elements occupies circuit area and brings manufacture complexity.

On the contrary, even the membrane area is determined, the amplitude of the air pulse generated by the SPD 10 is adjustable. Specifically, the amplitude of the air pulse generated by the SPD 10 can be determined and controlled by the first rotation angle $\varphi_a$ and the second rotation angle $\varphi_b$, or, equivalently, by the deflector control signals $V_{D,a}$ and $V_{D,b}$. One single SPD 10 is sufficient to produce air pulses with various amplitudes (in terms of, e.g., SPL). Thus, there is no need to include extra air pulse generating elements for producing air pulses with various amplitudes. Thus, the SPD 10 is suitable for apparatus with limited size, e.g., earphone. Compared to U.S. application Ser. No. 16/125,761, circuit area and manufacture complexity required by the SPD 10 are significantly reduced.

In short, via the membrane movement (by the membrane 102), the first deflector rotation (by the deflector 103_a) and the second deflector rotation (by the deflector 103_b), the SPD 10 is able to produce the plurality of air pulses with an air pulse rate.

Similar to U.S. application Ser. No. 16/125,761, the plurality of air pulses generated by the SPD 10 would have non-zero offset in terms of SPL, where the non-zero offset is a deviation from a zero SPL. Also, the plurality of air pulses generated by the SPD 10 is aperiodic over a plurality of pulse cycles. Details of the "non-zero SPL offset" and the "aperiodicity" properties may be refer to the U.S. application Ser. No. 16/125,761, which are not narrated herein for brevity.

Figure 3:
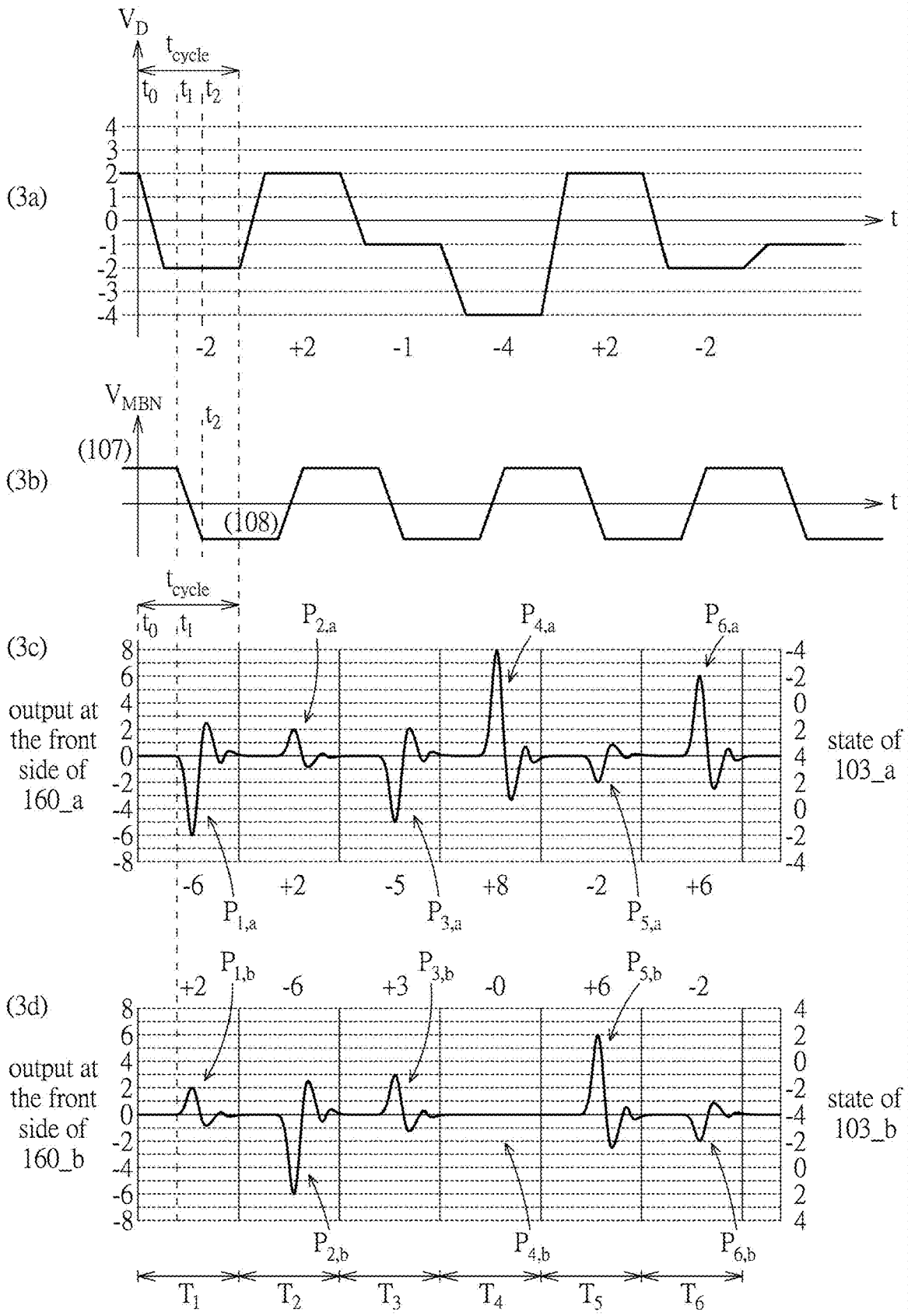
FIG. 3 is a timing diagram of a membrane control signal, a deflector control signal and a plurality of pulses observed at openings according to an embodiment of the present application.

For illustration purpose, FIG. 3 illustrates a dynamic operation of the SPD 10. The subfigures 3a and 3b illustrate timing diagram of the membrane control signal $V_{MBN}$ and a deflector control signal $V_D$, respectively. The subfigures 3c and 3d illustrate air pulses generated in response to the membrane control signal $V_{MBN}$ and the deflector control signal $V_D$, observed at the front side of the opening 160_a and the opening 160_b, respectively. In the current embodiment, the deflector control signal $V_D$ may be applied to both the deflector 103_*a* and the deflector 103_*b*. That is, the deflector control signal $V_D$ is the deflector control signal $V_{D,a}$ and the deflector control signal $V_{D,b}$.

In the current embodiment, the deflector control signal $V_D$ is scaled to be in a representative sequence of {−2, +2, −1, −4, +2, −2}, meaning that the deflector (103_*a* and 103_*b*) rotates to the states $S_{-2}$, $S_{+2}$, $S_{-1}$, $S_{-4}$, $S_{+2}$ and $S_{-2}$ sequentially. It can be understood that the deflector (103_*a* and 103_*b*) rotates to the states $S_n$ if $V_D$ is the representative number n (i.e., $V_D$=n). The membrane control signal $V_{MBN}$ drives the membrane 102 to toggle between the position 107 and the position 108, such that the membrane movement may be from the position 107 to the position 108, or from the position 108 to the position 107. The scale on the left side of the subfigures 3*c* and 3*d* is the "output pulse" with arbitrary unit, which may be, e.g., in terms of SPL. The scale on the right side of the subfigures 3*c* and 3*d* indicates the "state of deflector" for deflector 103_*a* and deflector 103_*b*.

In FIG. 3, $t_{cycle}$ is used to denote one pulse cycle and $T_1$-$T_6$ are used to denote 6 consecutive pulse cycles. Within the pulse cycle $t_{cycle}$, the deflector rotation occurs at the beginning and the membrane movement occurs consecutively. For example, the deflector rotates within a time interval between $t_0$ and $t_1$ within the pulse cycle $t_{cycle}$, and the membrane 102 moves between the positions 107 and 108 within a time interval between $t_1$ and $t_2$ within the pulse cycle $t_{cycle}$. It can be seen from FIG. 3 that the membrane control signal $V_{MBN}$ and the deflector control signal $V_D$ are mutually synchronized, such that the membrane movement and the first/second deflector rotation are mutually synchronized. Due to the synchronicity of the membrane movement and the deflector rotations, the SPD 10 is able to produce the plurality of air pulses In another perspective, within the pulse cycle $T_1$, the deflector control signal $V_D$ is set to be "−2", such that the deflectors 103_*a* and 103_*b* rotate to the state $S_{-2}$. In addition, the membrane movement is from the position 107 to the position 108, such that an air pulse $p_{1,a}$ (which may be scaled as "−6") may be produced/observed in the front side of the opening 160_*a* and an air pulse $p_{1,b}$ (which may be scaled as "+2") may be produced/observed in the front side of the opening 160_*b*. The air pulse $p_{1,a}$ (scaled as "−6") and the air pulse $p_{1,b}$ (scaled as "+2") would effectively produce a net air pulse, which would be scaled as "−4".

Similarly, air pulses $p_{2,a}$-$p_{6,a}$ are produced in the front side of the opening 160_*a* and air pulses $p_{2,b}$-$p_{6,b}$ are produced in the front side of the opening 160_*b*, in response to the deflector control signal $V_D$ in the sequence of {+2, −1, −4, +2, −2} while the membrane being toggled between positions 107 and 108, as the subfigures 3*a* and 3*b* illustrate. Net air pulses corresponding to the pulse cycles $T_2$-$T_6$ would be scaled as −4, −2, +8, +4, +4.

Note that, the air pulses $p_{1,a}$-$p_{6,a}$ the air pulses $p_{1,b}$-$p_{6,b}$ or the net air pulses may have cycle-to-cycle independence, which means that the polarity or the magnitude/amplitude of the air pulse of a current pulse cycle may be arbitrarily generated (via the membrane movement, the first deflector rotation and the second deflector rotation), regardless of which of a previous pulse cycle previous to the current pulse cycle.

Note that, the first deflector rotation and the second deflector rotation are symmetric. The symmetricity (between the first and second deflector rotations) means that for each pulse cycle, the deflectors 103_*a* and 103_*b* rotates by the same amount of angle. Mathematically, $|\varphi_a|=|\varphi_b|$ for each pulse cycle, where $-90° \leq \varphi_a, \varphi_b \leq 90°$, and the deflector rotation angles $\varphi_a$, $\varphi_b$ are referred to rotation angles compared to the neutral state $S_0$, at which $\varphi_a=\varphi_b=0$.

Note that, by properly designing the deflector control signal $V_D$ and the membrane control signal $V_{MBN}$, the plurality of net air pulses can be amplitude modulated, or pulse amplitude modulated. Essentially, the deflector control signal $V_D$ may be generated according to an input audio signal AUD, such that $|\varphi_a|$ or $|\varphi_b|$ (absolute value of the rotation angle, abbreviated as $|\varphi|$) within a pulse cycle $T_k$ may increase as an amplitude of a time-sample corresponding to the pulse cycle $T_k$ of the input audio signal AUD, regardless of sign or polarity of the time-sample, increases. Specifically, given $AUD_1$-$AUD_6$ represent time samples of the input audio signal AUD, supposed that $AUD_1$-$AUD_6$ (substantially) have a relationship of $AUD_1$:$AUD_2$:$AUD_3$:$AUD_4$:$AUD_5$:$AUD_6$=−4:−4:−2:+8:+4:+4, then the deflector control signal $V_D$ and the membrane control signal $V_{MBN}$ can be generated as the subfigures 3*a* and 3*b* illustrate, such that the plurality of net air pulses (produced by the SPD 10) corresponding to the pulse cycles $T_1$-$T_6$ would be scaled (substantially) as −4, −4, −2, +8, +4, +4. It can be observed that $|\varphi(T_4)|>|\varphi(T_1)|=|\varphi(T_2)|=|\varphi(T_5)|=|\varphi(T_6)|>|\varphi(T_3)|$, as $|AUD_4|>|AUD_1|=|AUD_2|=|AUD_5|=|AUD_6|>|AUD_3|$, where $|\varphi(T_k)|$ denotes the absolute value of the rotation angle corresponding to the pulse cycle $T_k$.

Notably, the embodiments stated in the above are utilized for illustrating the concept of the present application. Those skilled in the art may make modifications and alterations accordingly, which are not limited herein. For example, the embodiment stated in the above has 9 deflector rotation states, i.e., $S_{-4}$-$S_{+4}$, which is not limited thereto. A number of deflector rotation states can be much larger and/or a resolution of the deflector rotation can be much finer than the embodiment presented in FIG. 1 and FIG. 3.

Figure 4:
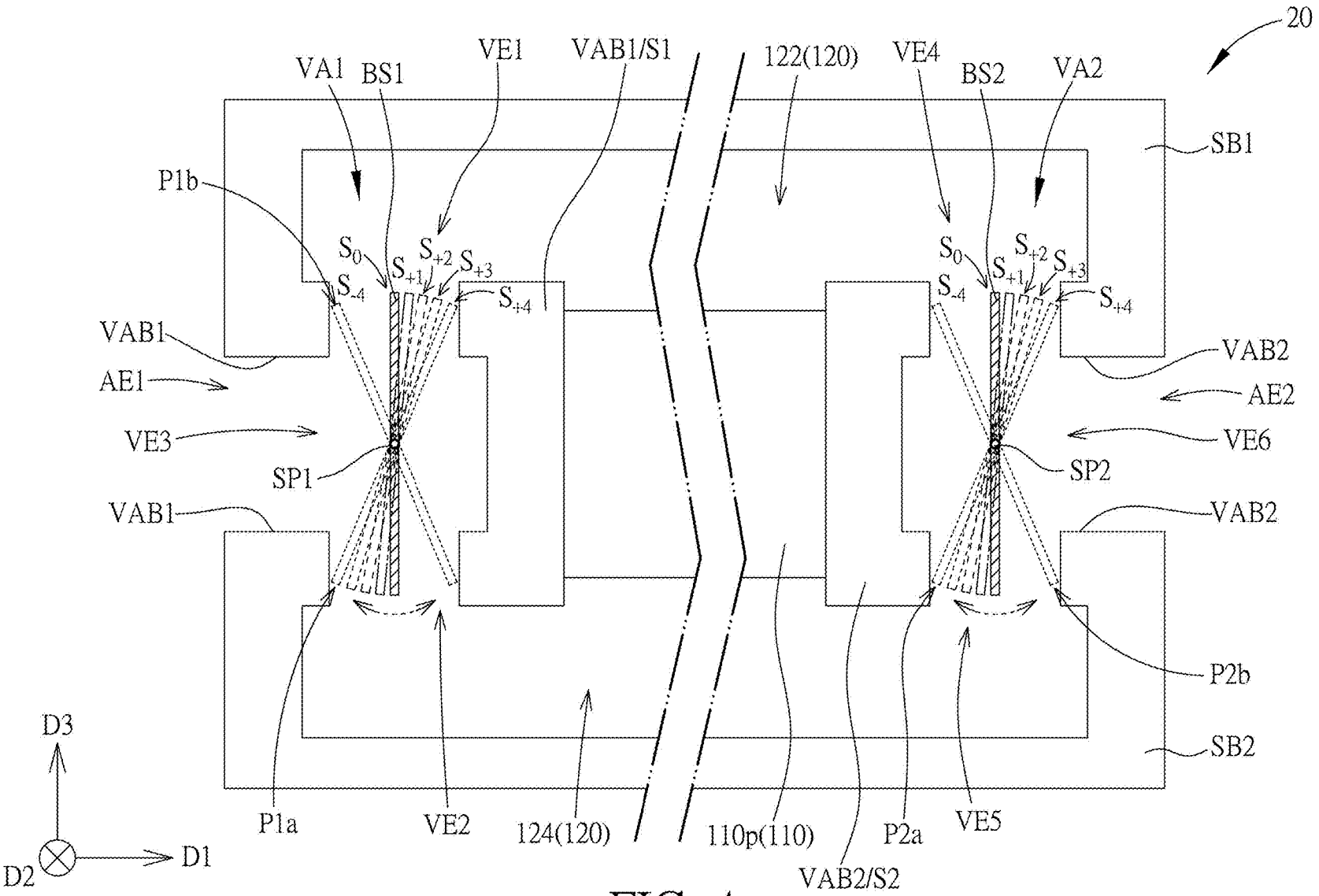
FIG. 4 is a schematic diagram of a sound producing device according to an embodiment of the present application.

In addition, the deflector distributing the air flow can be applied in different type(s) of air pulse generating element (or SPD). For example, FIG. 4 is a schematic diagram of an SPD 20 according to an embodiment of the present application. The SPD 20 is similar to the air pulse generating element 100 disclosed in FIG. 8 of U.S. application Ser. No. 16/368,870 by Applicant, which is inspired by "air motion transformer" proposed by Dr. Heil in U.S. Pat. No. 3,636,278. As U.S. application Ser. No. 16/368,870 teaches, the membrane 110 may comprise planar parts 110*p*. The planar part 110*p*, a part of the membrane 110, may be disposed at a plane spanned by the directions D1 and D2.

Different from U.S. application Ser. No. 16/368,870, the SPD 20 comprises a first deflector BS1 and a second deflector BS2. In other words, BS1 and BS2 in FIG. 4 of the present application represent the deflectors, instead of the blocking structures as taught by FIG. 8 of U.S. application Ser. No. 16/368,870.

Operations of the SPD 20 are similar to those of the SPD 10. The deflectors BS1 and BS2 are two deflectors controlling entrances/openings VE3 and VE6, respectively. At the deflector neutral state $S_0$, when BS1 and BS2 are both in vertical alignment as drawn, the net output at the entrances/openings VE3 and VE6 would be 0, because equal quantity but of opposite polarity of air pressure (or air movement) are produced from sub-chambers 122 and 124, which are canceled out by each other. At the deflector state $S_4$, when BS1 is in the P1*a* alignment and BS2 is in the P2*a* alignment, the output air mass velocity at the entrance/opening VE3 will be corresponding to the air mass velocity within the sub-chamber 122 and the output air mass velocity at the entrance/opening VE6 will be corresponding to the air mass velocity within the sub-chamber 124. At the deflector state $S_{-4}$, when the deflector BS1 is in the P*b* alignment and the deflector BS2 is in the P2*b* alignment, the output air mass velocity at the entrance/opening VE3 will be parallel to the air mass velocity of sub-chamber 124 and the output air mass velocity at the entrance VE6 will be parallel to the air mass velocity of the sub-chamber 122. The relationship between the deflector and membrane control signals versus the (net) air pulses is similar to FIG. 3, which is not narrated for brevity.

Note that, the deflectors BS1 and BS2 are disposed at a plane spanned by the directions D2 and D3 at the deflector neutral state. Different from the SPD 10 illustrated in FIG. 1, the deflectors BS1 and BS2 at the deflector neutral state are perpendicular to the planar part 110*p*, a part of the membrane 110. Furthermore, the deflectors can be applied to pulse generating element (or SPD) exploiting "side firing" structure, in which air mass velocity produced by the membrane movement within the sub-chambers are parallel to air mass velocity flowing through the entrances/openings. For the SPD with the "side firing" structure, the deflectors at the deflector neutral state are perpendicular to (a part of) the membrane.

There is another aspect of SPD20 which is different from SPD10 where the net SPL needs to be derived by summing the outputs from two openings 106_*a* and 106_*b*. In SPD20, the output at opening VE3 is already the summed result from chamber 122 and chamber 124 and therefore the net SPL is produced directly. This difference came from the fact that deflector BS1 (or BS2) deflects the air pulses generated by both sub-chamber 122 and sub-chamber 124, while in SPD10 each deflector, 103_*a* or 103_*b*, deflects only the air pulses generated by one of the two chambers. In other words, the net SPL output through the opening VE3/VE6 is produced by aggregating air flow within the both the sub-chamber 122 and the sub-chamber 124.

Figure 5:
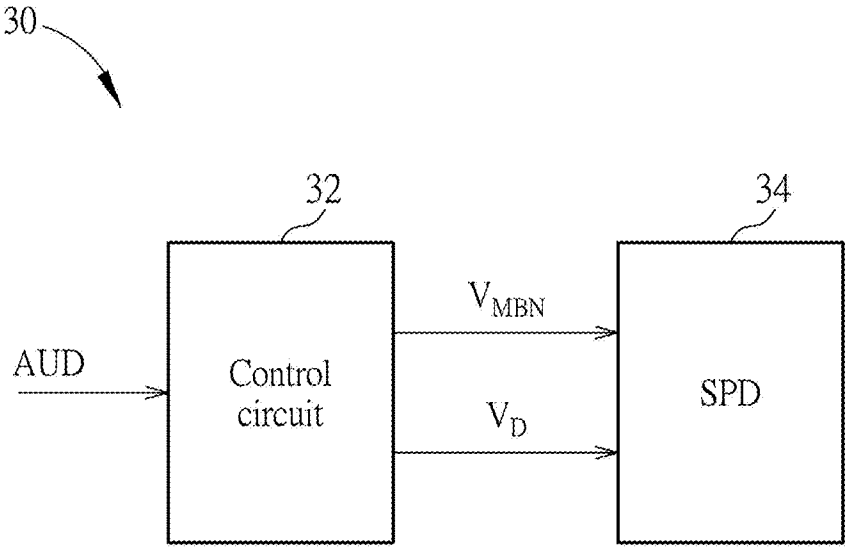
FIG. 5 is a schematic diagram of a sound producing apparatus according to an embodiment of the present application.

The SPD comprising the deflectors (e.g., the SPD 10 or the SPD 20) can be disposed within a sound producing apparatus. FIG. 5 is a schematic diagram of a sound producing apparatus 30 according to an embodiment of the present application. The sound producing apparatus 30 comprises a control circuit 32 and an SPD 34. The SPD 34 can be realized by either SPD 10 or the SPD 20. The control circuit 32 may receive the input audio signal AUD and generate the membrane control signal $V_{MBN}$ and the deflector control signal $V_D$ (or $V_{D,a}/V_{D,b}$) according to the input audio signal AUD, such that the SPD 34 produces a plurality of amplitude modulated air pulses, which are amplitude modulated according to the input audio signal AUD.

In both embodiments SPD10 and SPD20, the movements of the membranes are fixed in terms of both cycle time and amplitude. The PAM, including "zero", is accomplished through the relationship between the rotational angle and the direction of ultrasonic air pulse of each cycle.

As can be seen from the above, instead of using valves having either ON or OFF status, the deflectors rotating various angles may have various rotation states. Since the amplitude of the output air pulse is determined by the rotation angle and the rotation angle is controlled by the deflector control signal, the SPD with deflectors by itself would own a room for pulse amplitude modulation. That is, the SPD with deflectors by itself is capable of producing the plurality of air pulses with various amplitudes, which can be amplitude modulated according to the input audio signal. In comparison, one single air pulse generating element with valves can only generate air pulse with fixed amplitude, and multiple air pulse generating elements (with valves) are required to produce air pulses with various amplitudes, which requires more circuit area and manufacture complexity.

In summary, the SPD of the present application includes deflector to divert the air flow toward the front/back direction, so as to produce amplitude modulated air pulses. Due to bypassing the requirement of the plurality of air pulse generating elements, circuit area and manufacture complexity are significantly reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound producing device, comprising:

a membrane, disposed within a chamber, controlled by a membrane control signal to cause a membrane movement; and a first deflector, disposed within a first opening by the membrane, controlled by a first deflector control signal to cause a first deflector rotation;

wherein the sound producing device produces a plurality of air pulses via the membrane movement and the first deflector rotation, the plurality of air pulses has an air pulse rate, and the air pulse rate is higher than a maximum human audible frequency;

wherein the plurality of air pulses produces a non-zero offset in terms of sound pressure level, and the non-zero offset is a deviation from a zero sound pressure level.

2. The sound producing device of claim 1, wherein the plurality of air pulses is aperiodic over a plurality of pulse cycles.

3. The sound producing device of claim 1, wherein a first rotation angle of the first deflector rotation has a monotonic relationship with the first deflector control signal.

4. The sound producing device of claim 3, wherein the first deflector control signal is generated according to an input audio signal, a first absolute value of the first rotation angle within a pulse cycle increases as an amplitude of a time-sample corresponding to the pulse cycle of the input audio signal increases.

5. The sound producing device of claim 1, further comprising a first pivot, wherein the first deflector rotates around the first pivot.

6. The sound producing device of claim 1, wherein the membrane control signal and the first deflector control signal are mutually synchronized, such that the membrane movement and the first deflector rotation are mutually synchronized.

7. The sound producing device of claim 1, further comprising a second deflector, disposed within a second opening by the membrane, controlled by a second deflector control signal to cause a second deflector rotation;

wherein the sound producing device produces the plurality of air pulses via the membrane movement, the first deflector rotation and the second deflector rotation.

8. The sound producing device of claim 7, wherein a second rotation angle of the second deflector rotation has a monotonic relationship with the second deflector control signal.

9. The sound producing device of claim 8, wherein the second deflector control signal is generated according to an input audio signal, and a second absolute value of the second rotation angle within a pulse cycle increases as an amplitude of a time-sample corresponding to the pulse cycle of the input audio signal increases.

10. The sound producing device of claim 7, further comprising a second pivot, wherein the second deflector rotates around the second pivot.

11. The sound producing device of claim 7, wherein the membrane control signal and the second deflector control signal are mutually synchronized, such that the membrane movement and the second deflector rotation are mutually synchronized.

12. The sound producing device of claim 7, wherein the membrane partitions the chamber into a first sub-chamber and a second sub-chamber, the first deflector aligns with the first sub-chamber, and the second deflector aligns with second the sub-chamber.

13. The sound producing device of claim 7, wherein the first deflector and the second deflector at a neutral state are parallel to the membrane.

14. The sound producing device of claim 7, wherein the first deflector and the second deflector at a neutral state are perpendicular to a part of the membrane.

15. The sound producing device of claim 7, wherein the first deflector rotation and the second deflector rotation are symmetric.

16. The sound producing device of claim 7, wherein the membrane partitions the chamber into a first sub-chamber and a second sub-chamber, the first deflector deflects an air pulse generated by both the first sub-chamber and the second sub-chamber, and a net sound pressure level (SPL) output through the first opening is produced by aggregating air flow within the both the first sub-chamber and the second sub-chamber.

17. A sound producing apparatus, comprising:

the sound producing device of claim 1; and a control circuit, configured to generate the membrane control signal and the first deflector control signal.

* * * * *